United States Patent [19]

Blevins

[11] Patent Number: 4,853,083

[45] Date of Patent: Aug. 1, 1989

[54] METHOD OF FORMING BEATER-SATURATED SHEET USING CARBONATE ION

[75] Inventor: Jack F. Blevins, Leola, Pa.

[73] Assignee: Armstrong World Industries, Inc., Lancaster, Pa.

[21] Appl. No.: 238,405

[22] Filed: Oct. 3, 1988

Related U.S. Application Data

[63] Continuation of Ser. No. 74,769, Jul. 17, 1987, abandoned, which is a continuation-in-part of Ser. No. 588,194, Mar. 12, 1984, abandoned, which is a continuation-in-part of Ser. No. 518,952, Aug. 1, 1983, abandoned.

[51] Int. Cl.[4] ..... D21H 3/36; D21H 5/12

[52] U.S. Cl. ..... 162/145; 162/146; 162/168.1; 162/169; 162/181.1; 162/181.2; 162/181.5; 162/183

[58] Field of Search ..... 162/145, 146, 169, 181.2, 162/181.5, 170, 183, 168.1, 181.1

[56] References Cited

U.S. PATENT DOCUMENTS

| | | | |
|---|---|---|---|
| 3,082,145 | 3/1963 | Kao | 162/169 |
| 3,344,016 | 9/1967 | Moggio et al. | 162/169 |
| 3,344,017 | 9/1967 | Lesniak | 162/169 |

*Primary Examiner*—Peter Chin

[57] ABSTRACT

Method of forming a beater-saturated non-woven sheet by treating a slurry of papermaking fibers with alum and either sodium carbonate or a mixture of sodium bicarbonate and sodium hydroxide to achieve a pH in the range of about 7–9 followed by adding a binder latex which deposits on the fibers, and finally forming a sheet from the resulting slurry.

16 Claims, No Drawings

METHOD OF FORMING BEATER-SATURATED SHEET USING CARBONATE ION

CROSS REFERENCE TO RELATED APPLICATION

This application is a continuation application of U.S. application Ser. No. 74,769 filed July 17, 1987, now abandoned, which is a continuation-in-part of U.S. application Ser. No. 588,194 filed Mar. 12, 1984, now abandoned, which is a continuation-in-part of U.S. application Ser. No. 518,952 filed Aug. 1, 1983, now abandoned in the name of Jack F. Blevins and entitled "Method of Forming Beater-Saturated Sheet Using Carbonate Ion."

BACKGROUND OF THE INVENTION

1. Field of the Invention

The invention relates to a method of forming non-woven flooring backing by the beater-saturated method in which the white water does not accumulate ammonium sulfate or multivalent cations which interfere with the precipitation process.

2. Description of the Prior Art

U.S. Pat. No. 2,375,245-Pretzel teaches the pretreatment of a papermaking fibrous slurry with alum and ammonia to form aluminum hydroxide in and around the papermaking fibers so that a subsequently adder binder latex will without further precipitation agent addition, precipitate and act as a binder during the sheet-laying process. U.S. Pat. No. 2,599,092-Craig teaches the addition of calcium chloride to a slurry of cellulosic fiber stock followed by the addition of sodium carbonate to precipitate calcium carbonate within the fibers in order to form a stiffer board. U.S. Pat. No. 3,082,145-Kao teaches a process of simultaneously coating cork granules and fibers with a coating material which may be a rubber latex. The process calls for pretreating with a salt which may be alum and adding an alkali which may be sodium carbonate or sodium hydroxide to a pH of approximately 5; no aluminum hydroxide appears to be formed. A latex is then added followed by the addition of a latex coagulant such as alum. U.S. Pat. No. 3,549,485-Eckert teaches a method of forming a mineral fiber-clay ceramic board by adding aluminum sulfate to a slurry of the mineral fiber and clay and then adding a deflocculant such as sodium carbonate or sodium hydroxide. And then there is U.S. Pat. No. 123747-Tiemann which issued Feb. 13, 1872. Here a papermaking slurry is pretreated with alum and followed by a treatment with "freshly-burned lime which has been previously slacked" in order to form a precipitate of "hydrate of alumina", doubtless aluminum hydroxide.

SUMMARY OF THE INVENTION

The aqueous slurry of papermaking fibers, along with any fibrous or nonfibrous fillers, is treated with papermaker's alum and sodium carbonate in indifferent order to achieve in the slurry a pH in the range of about 7–9. A mixture of sodium hydroxide and sodium bicarbonate may replace the sodium carbonate. A suitable binder latex is then added to the carbonate-treated slurry. On agitation, the latex-containing slurry begins to form small clumps as the latex particles precipitate on the fibers. Additionally, any multivalent cations, particularly $Ca^{++}$, will precipitate as carbonate. This system prevents the formation of ammonium sulfate in the white water as occurs when the alum-ammonia process is used as described above in connection with the Pretzel patent. While it has not yet been established, ammonium sulfate may be deleterious to aquatic life in rivers, streams and lakes to which the white water ultimately finds its way. Additionally, multivalent cations slowly accumulate in recycled white water as the water slowly extracts those cations from clays and other fillers. In time, the accumulated multivalent cations interfere with the precipitation of the binder latex thus making it necessary to discharge and replace the white water with fresh water more often than is economically desirable.

DESCRIPTION OF THE PREFERRED EMBODIMENT

The slurry of papermaking fibers will comprise those fibers, fillers, and additives normally used in making a non-woven flooring backing. Among the cellulosic fibers may be mentioned sulfite pulp, kraft, soda pulp, cotton aids, cotton linters, rags, and newsprint. Inorganic fibers such as glass, mineral wool, asbestos, wollastonite, may be used along with organic polymeric fibers of polyethylene, polypropylene, polyester, polyvinyl chloride, and others. The stock is formed by adding the fibers to water along with desirable fillers such as the clays, some silicates, carbon black, and other suitable fillers. Swelling agents for the cellulosic fibers may be added along with antioxidants, colorants, and additives such as titanium dioxide to increase the opacity of the final sheet. The consistency of the slurry will be in the range of about 0.5–5%. The stock of a suitable consistency may be subjected to mechanical refinement until the desired degree of freeness is obtained. The freeness of the paper-making slurry to be used in the present invention will generally be in the range of about 200 to 400.

The slurry will then be treated with either papermaker's alum or sodium carbonate. The amount of alum to be added to a slurry will generally be in the range of about 10% to 90%, based on the weight of the dry latex solids. One of the points of control of the present precipitation process is the amount of alum initially added; using smaller amounts within the range stated give a larger precipitated floc size and usually exhibit a longer latex precipitation time while greater amounts give a smaller precipitated floc size and usually exhibit a shorter latex precipitation time. A latex precipitation time in the range of about 2 to 5 minutes is generally preferred.

Once the alum has been added in the form of a solid or water solution and thoroughly dissolved in the slurry, the sodium carbonate will be added in one embodiment. Sodium carbonate may be added in the form of a solid or aqueous solution and will be added until the pH of the papermaking slurry is in the range of about 7–9. The preferred embodiment is to achieve a pH of 8. The reaction of the sodium carbonate with the previously added alum produces aluminum hydroxide and sodium sulfate. The aluminum hydroxide precipitates on and around the fibers and fillers in the papermaking slurry and brings about the smooth even deposition of the latex particles upon addition to the binder latex emulsion. Additionally, the carbonate ions from the sodium carbonate will react will multivalent cations, particularly calcium, and produce a precipitate of calcium carbonate which then serves as an additional finely divided filler in the ultimate sheet. The advantage of using sodium carbonate instead of the ammonium hydroxide of the Pretzel process is that ammonium sulfate may be objectionable in waterways containing fish while sodium sulfate is not. Further, the removal of the calcium ions from the white water allows the white water to be recycled more often than would otherwise be the case where ammonium hydroxide is added to the alum-treated slurry. Ammonium hydroxide allows the unreacted calcium ions and other ions in the white water to accumulate to undesirable levels. Other divalent ions present in the white water are those of iron, magnesium, manganese, nickel, copper, and zinc. As these collective ions accumulate in the white water, all of them will produce an increasing detrimental effect on the subsequent precipitation of the latex particles.

It is possible to use sodium bicarbonate as the treating agent for the alum-treated slurry instead of sodium carbonate. However, the addition of sodium bicarbonate alone will never achieve a pH of greater than about 7. While the latex and cation precipitation will occur at a pH of 7, it is not the preferred embodiment. The addition of sodium hydroxide to the sodium bicarbonate will allow achieving the desired pH of about 8, and so that mixture of sodium bicarbonate-sodium hydroxide can be used, again, in indifferent order of addition relative to the alum addition. In such case, sufficient sodium bicarbonate should be used to convert all the multivalent cations to carbonates. The sodium hydroxide function is merely to reach the desired pH.

Use of the sodium carbonate makes it possible to maintain consistent latex deposition times and floc size. The retention of fiber and fillers is increased and the ultimate sheet has a higher tensile strength. pH control of the slurry is improved as opposed to the alum/ammonia process of the Pretzel patent. Elimination of the multivalent cations enables use of binder latices which are too ion sensitive for use in the alum/ammonia process.

Some rubber latexes are significantly more stable than others, resulting in increased precipitation time in the present process. This increased stability may be due to the surfactants in the latex or the manner in which any carboxyl groups are introduced into the polymer chain. The precipitation time may be brought back to normal by adding the sodium carbonate first. This achieves a pH of about 10. The alum is then added to reach a pH of about 7 to form the appropriate aluminum hydroxide. The process then proceeds normally.

Having achieved the desired pH in the carbonate-treated slurry, the appropriate binder latex is merely added to the slurry with agitation. Over a period of several minutes the particles in the binder latex will deposit on and around the fibers and fillers, producing a larger, more uniform composite floc and a clear supernatant.

The binder latex may be any of the tacky synthetic latices well known in the paper- and felt-making art. Copolymers of butadiene and styrene, copolymers of butadiene and acrylonitrile, many of the neoprenes which are polymers of 2-chloro-butadiene-1,3, homopolymers of butadiene, the acrylic latices, and others may be employed. The binder latex is merely poured into the slurry with agitation to bring about the precipitation. The amount of latex to be added will be dependent upon the amount of binder desired in the final sheet. This will normally range in the amount of about 3 to 30% by weight binder based on the dry weight of the fibers and fillers.

The final step in the method is the forming of the resulting mixture into a sheet. The sheet may be formed in a conventional way by feeding the mixture to any paper-forming machine, such as a Fourdrinier, cylinder machine, wet machine, or the like for forming into fibrous sheets. The sheet will be dried in normal fashion.

The following examples illustrate several embodiments of the invention.

EXAMPLE 1

Two hand sheets were made, designated 4535 and 5048, each having the ingredients listed below. All parts are by weight unless otherwise stated. The calcium chloride was added to simulate a slurry containing a rather large amount of calcium ion. Following are the data:

| Ingredients | 4535 | 5048 |
|---|---|---|
| Unbleached Kraft | 4.6 | 4.6 |
| Newsprint | 2.3 | 2.3 |
| ⅛" DE670-6 Glass Fiber | 1.39 | 1.39 |
| ⅛" Polyester Fiber | 1.39 | 1.39 |
| Pulpex E-A, polyethylene fiber | 0.83 | 0.83 |
| Wollastonite P-1 | 14.5 | 14.5 |
| Klondyke KWW Clay | 14.5 | 14.5 |
| Celite 321, diatomaceous earth | 10.5 | 10.5 |
| Kymene 2064, an amine polymer/epichlorohydrin adduct | 0.345 | 0.345 |
| TINOX antioxidant, a substituted cresol | 0.066 | 0.066 |
| Carbon Black | 0.0125 | 0.0125 |
| Water | 2500 cc | 2500 cc |
| Polysar PL-255 Latex, a carboxylated styrene/butadiene latex | 7.5 | 7.5 |
| Alum | 0.5 | 2.75 |
| $NH_4OH$ | to 7 pH | — |
| $Na_2CO_3$ | — | to 8 pH |
| $CaCl_2$ (0.1 M) | 100 cc | 100 cc |
| Precipitation Time | 45 sec | 2.5 min |
| Canadian Standard Freeness | 510 | 660 |
| Sheet Weight | 51.9 | 55.3 |
| Tensile Strength | | |
| (73.4° F.) | 29.5 lbs | 37.4 lbs |
| (350° F.) | 12.4 lbs | 20.5 lbs |
| $Ca^{++}$ level in white water | 204 PPM | 10 PPM |

EXAMPLE 2

Four hand sheets were made containing the ingredients below. Except for increasing calcium ion concentrations, all four sheets are the same. The purpose of this example is to show the effect on the Canadian Freeness, precipitation time, and calcium ion remaining in the white water of the prior art alum-ammonium process. The addition of extra ammonia to a pH greater than 7 causes no change in any of the parameters.

| Ingredients | 5143 | 5144 | 5145 | 5146 |
|---|---|---|---|---|
| Unbleached Kraft | 2.76 | " | " | " |
| Newsprint | 2.76 | " | " | " |
| Glass OC-670-6 ⅛" | 1.12 | " | " | " |
| Pulpex E-A polyethylene fiber | 1.76 | " | " | " |
| Wollastonite P-1 | 11.6 | " | " | " |

-continued

| Ingredients | 5143 | 5144 | 5145 | 5146 |
|---|---|---|---|---|
| Klondyke clay | 11.6 | " | " | " |
| Celite 321 (diatomaceous earth) | 8.4 | " | " | " |
| Kymene 2064 (epichlorohydrin adduct) | 0.276 | " | " | " |
| TINOX (antioxidant) | 0.0528 | " | " | " |
| Carbon Black | 0.01 | " | " | " |
| Polysar PL-255 (carboxylated SBR) | 6.0 | " | " | " |
| $H_2O$ (2% consistency) | 2000 cc | " | " | " |
| Alum | 3.0 | " | " | " |
| $CaCl_2$ (0.1 M) | — | 20 cc | 40 cc | 80 cc |
| $NH_3$ | to pH 7 | " | " | " |
| Canadian Freeness | 660 | 620 | 630 | 520 |
| Precipitation time | 2 min | 1¾ min | 1¾ min | 1 min |
| $Ca^{++}$ concentration level in white water | 47.3 PPM | 84.2 PPM | 109.0 PPM | 182.8 PPM |

EXAMPLE 3

A series of four hand sheets was made having the same ingredients except for increasing amounts of calcium ion in the slurry. This example shows the results of using sodium carbonate to a pH of 7. While the precipitation of the binder latex remains controllable, the amount of calcium ion in the white water increases, although not as much as the attendant increase in using the alum ammonia process illustrated by Example 2.

EXAMPLE 4

This example illustrates the preferred embodiment in that the sodium carbonate is added to achieve a pH of 8 in the slurry prior to the addition of the binder latex. Precipitation time remains constant despite increase in calcium ion since a substantial amount of the calcium ion has been removed by precipitation as calcium carbonate.

| Ingredients | 5147 | 5148 | 5149 | 5150 |
|---|---|---|---|---|
| Unbleached Kraft | 2.76 | " | " | " |
| Newsprint | 2.76 | " | " | " |
| Glass OC-670-6 | 1.12 | " | " | " |
| Pulpex E-A | 1.76 | " | " | " |
| Wollastonite P-1 | 11.6 | " | " | " |
| Klondyke Clay | 11.6 | " | " | " |
| Celite 321 | 8.4 | " | " | " |
| Kymene 2064 | 0.276 | " | " | " |
| TINOX | 0.0528 | " | " | " |
| Carbon Black | 0.01 | " | " | " |
| Polysar PL-255 | 6.0 | " | " | " |
| $H_2O$ (2% consistency) | 2000 cc | " | " | " |
| Alum | 3.0 | " | " | " |
| $CaCl_2$ (0.1 M) | — | 20 cc | 40 cc | 80 cc |
| $Na_2CO_3$ | 1.9 | 2.0 | 2.0 | 2.1 |
| Canadian Freeness | 690 | 680 | 680 | 660 |
| Precipitation Time | 2¼ min to pH 7 | 2 min " | 1¾ min " | 1½ min " |
| $Ca^{++}$ concentration level in white water | 40.5 PPM | 70.5 PPM | 91.4 PPM | 145.9 PPM |

| Ingredients | 5155 | 5156 | 5157 | 5158 |
|---|---|---|---|---|
| Unbleached Kraft | 2.76 | " | " | " |
| Newsprint | 2.76 | " | " | " |
| Glass OC-670-6 | 1.12 | " | " | " |
| Pulpex E-A | 1.76 | " | " | " |
| Wollastonite P-1 | 11.6 | " | " | " |
| Klondyke Clay | 11.6 | " | " | " |
| Celite 321 | 8.4 | " | " | " |
| Kymene 2064 | 0.276 | " | " | " |
| TINOX | 0.0528 | " | " | " |
| Carbon Black | 0.01 | " | " | " |
| Polysar PL-255 | 6.0 | " | " | " |
| $H_2O$ (2% Consistency) | 2000 cc | " | " | " |
| Alum | 3.0 | " | " | " |
| $CaCl_2$ (0.1 M) | — | 20 cc | 40 cc | 80 cc |
| $Na_2CO_3$ | 2.3 | 2.4 | 2.5 | 2.7 |
| Canadian Freeness | 700 | 670 | 710 | 680 |
| Precipitation Time | 2½ min to pH 8 | 2¼ min " | 2½ min " | 2¼ min " |
| $Ca^{++}$ concentration level | | | | |

-continued

| Ingredients | 5155 | 5156 | 5157 | 5158 |
|---|---|---|---|---|
| in white water | 19.6 PPM | 37.3 PPM | 36.9 PPM | 54.5 PPM |

EXAMPLE 5

A hand sheet having the ingredients of Example 4 was prepared. After the addition of the alum, and sufficient $CaCl_2$ to give a $CA^{++}$ $CA^{++}$ content of 160 PPM, sodium hydroxide in amount of 0.63 parts was added to achieve a pH of 8. There was then added 3 parts of sodium bicarbonate. The Canadian Freeness of the resulting slurry was 700, the precipitation time was 2 minutes, and the remaining calcium ion concentration was 43 PPM.

EXAMPLE 6

A hand sheet, designated 5487, was made having the ingredients listed below.

| Ingredients | 5487 |
|---|---|
| Unbleached Kraft fiber | 5.0 |
| Newsprint | 2.2 |
| Glass fiber, OC-670-6 | 1.4 |
| Polyester fiber | 1.4 |
| Polyethylene fiber | 2.2 |
| Klondyke clay | 22.5 |
| Wollastonite | 11.5 |
| Diatomaceous earth | 6.0 |
| Kymene 2064 (epichlorohydrin adduct) | 0.25 |
| Flectol H (antioxidant, a hydroquinoline type) | 0.3 |
| Carbon black | 0.013 |
| Alum | 3.0 |
| Water (2% consistency) | 2500 cc |
| Sodium carbonate | 2.34 |
| Carboxylated styrene/butadiene latex (Dow 283) | 10.0 |
| Canadian freeness | 610 |
| Precipitation time | 3½ min. |

The sodium carbonate was added first to the slurry. The pH was about 10. The alum addition then brought the pH to 7. Sheet formation was normal.

I claim:

1. The method of forming a beater-saturated, nonwoven sheet comprising forming in water a slurry of paper-making fibers, in indifferent order (1) adding alum to the slurry, and (2) adding sodium hydroxide and sodium bicarbonate, to precipitate aluminum hydroxide on and around the fibers, the pH of the slurry after addition of both alum and bicarbonate being in the range of 7 to 9, adding a binder latex to the carbonate-treated slurry, agitating the latex-containing slurry to precipitate the binder onto the fibers and to precipitate any multivalent cations as carbonates, and forming a sheet from the resulting slurry.

2. The method of claim 1 in which the papermaking fibers are selected from the group consisting of cellulosic fibers, glass fibers, and polyolefin fibers.

3. The method of claim 1 in which the alum is added to the slurry and then the sodium hydroxide and sodium bicarbonate is added to the alum-treated slurry.

4. The method of claim 3 in which the paper-making fibers are selected from the group consisting of cellulosic fibers, glass fibers, and polyolefin fibers.

5. The method of claim 3 in which particulate fillers are included in the papermaking slurry.

6. The method of claim 3 in which the binder latex consists of a carboxylated styrene-butadiene rubber.

7. The method of claim 3 in which the pH is about 8.

8. The method of claim 1 in which the fibers are selected from the group consisting of cellulose, glass, and polyolefin fibers, the pH is about 8, and the binder latex is a carboxylated styrene-butadiene rubber.

9. The method of forming a beater-saturated, nonwoven sheet comprising forming in water a slurry of paper-making fibers, adding to the slurry first sodium carbonate, and then alum, to precipitate aluminum hydroxide on and around the fibers, the pH of the slurry after addition of both sodium carbonate and alum being in the range of 7 to 9, adding a binder latex to the carbonate and alum treated slurry, agitating the latex-containing slurry to precipitate the binder onto the fibers and to precipitate any multi-valent cations as carbonates, and forming a sheet from the resulting slurry.

10. The method of claim 9 in which the paper-making fibers are selected from the group consisting of cellulosic fibers, glass fibers, and polyolefin fibers.

11. The method of forming a beater-saturated, nonwoven sheet comprising forming in water a slurry of paper-making fibers in the presence of at least 20 ppm calcium or other multivalent cations, adding alum to the slurry, adding sodium carbonate to the alum-treated slurry to a pH in the range of 7 to 9 to precipitate aluminum hydroxide on and around the fibers, adding a binder latex to the carbonate-treated slury, agitating the latex-containing slurry to precipitate the binder onto the fibers and to precipitate the calcium or other multivalent cations as carbonates, and forming a sheet from the resulting slurry.

12. The method of claim 11 in which the paper-making fibers are selected from the group consisting of cellulosic fibers, glass fibers, and polyolefin fibers.

13. The method of claim 11 in which particulate fillers are included in the papermaking slurry.

14. The method of claim 11 in which the binder latex consists of a carboxylated styrene-butadiene rubber.

15. The method of claim 11 in which the pH is about 8.

16. The method of claim 11 in which the fibers are selected from the group consisting of cellulose, glass, and polyolefin fibers, the pH is about 8, and the binder latex is a carboxyalted styrene-butadiene rubber.

* * * * *